US005503765A

United States Patent [19]

Schepers et al.

[11] Patent Number: 5,503,765

[45] Date of Patent: Apr. 2, 1996

[54] STABLE NON-AQUEOUS COMPOSITIONS CONTAINING PERACIDS WHICH ARE SUBSTANTIALLY INSOLUBLE

[75] Inventors: Frederik J. Schepers, Breukelen, Netherlands; Leslie J. Morgan, Jersey City; Daniel J. Kuzmenka, Wallington, both of N.J.; Jonathan F. Warr, Wirral, Great Britain

[73] Assignee: Lever Brothers Company, Division of Conopco, Inc., New York, N.Y.

[21] Appl. No.: 290,313

[22] Filed: Aug. 12, 1994

Related U.S. Application Data

[63] Continuation-in-part of Ser. No. 113,487, Aug. 27, 1993, abandoned.

[51] Int. Cl.[6] ..... C11D 3/395; C11D 7/54; C11D 7/38

[52] U.S. Cl. ..... 252/95; 252/98; 252/99; 252/102; 252/135; 252/174.12; 252/186.42; 252/DIG. 12; 252/DIG. 14; 8/111

[58] Field of Search ..... 252/95, 98, 99, 252/102, 174.12, 186.42, 135, 186.39, DIG. 12, DIG. 14; 8/107, 111

[56] References Cited

U.S. PATENT DOCUMENTS

| | | | |
|---|---|---|---|
| 4,634,551 | 1/1987 | Burns et al. | 252/102 |
| 4,686,063 | 8/1987 | Burns | 252/102 |
| 4,981,606 | 1/1991 | Barnes | 252/95 |
| 5,055,218 | 10/1991 | Getty et al. | 252/94 |
| 5,061,807 | 10/1991 | Gethoffer et al. | 548/473 |
| 5,234,617 | 8/1993 | Hunter et al. | 252/102 |
| 5,248,434 | 9/1993 | Nicholson | 252/95 |
| 5,268,003 | 12/1993 | Coope et al. | 8/111 |

FOREIGN PATENT DOCUMENTS

| | | |
|---|---|---|
| 0484095 | 5/1992 | European Pat. Off. . |

*Primary Examiner*—Paul Lieberman
*Assistant Examiner*—Lorna M. Douyon
*Attorney, Agent, or Firm*—Ronald A. Koatz

[57] ABSTRACT

Non-aqueous liquids into which peracids may be stably incorporated for five days or greater when measured at 37° C. are formulated by proper selection of substantially insoluble peracid, builder and buffer salts.

26 Claims, No Drawings

STABLE NON-AQUEOUS COMPOSITIONS CONTAINING PERACIDS WHICH ARE SUBSTANTIALLY INSOLUBLE

RELATED CASES

The present application is a continuation-in-part of U.S. Ser. No. 08/113,487 to Schepers et al filed on Aug. 27, 1993, now abandoned.

FIELD OF THE INVENTION

The present invention relates to non-aqueous liquid compositions (NALs) containing peracids which are substantially insoluble in the compositions. Preferably, the NALs additionally contain solids (i.e., builders and/or buffer salts) which are selected according to specific stability criteria, i.e., how stable peracids are when measured in nonionic surfactants containing the builder or buffer salts.

BACKGROUND OF THE INVENTION

Peroxyacids have powerful oxidizing capacity which enables them to bleach household stains. These compounds also have powerful disinfectant and sanitizing properties which are generally superior to products which generate hydrogen peroxide when used under the same conditions.

While it would be greatly desirable to offer liquid compositions, particularly non-aqueous compositions, containing peroxyacids, the art teaches that there are special difficulties in preparing such compositions resulting in the decomposition of the peroxyacids.

U.S. Pat. No. 3,956,159 to Jones, for example, teaches that the reactive nature of peroxyacids presents special problems to the formulator upon storage of bleach in liquid media. The patent teaches the combination of a number of ingredients, including organic solvent, to stabilize the bleach. The reference fails to teach, however, how to incorporate a peroxyacid in a liquid composition which is based on surfactant instead of merely an organic solvent. Moreover, there is no suggestion that, if a non-aqueous liquid were used, even this would have to be specifically formulated to ensure stability. That is, even the peracids of the invention are not stable in all NAL formulations.

U.S. Pat. No. 4,783,278 to Sanderson et al. teaches that particulate potassium-4-sulphoperoxybenzoic acid is stable when dispersed in an organic liquid carrier phase comprising a nonionic surfactant. The amido and imido acids of the subject invention are neither taught nor suggested. Further, the reference teaches that other solid peracids dispersed in liquid nonionic surfactants result in instability, presumably because of the detrimental interaction between ethoxylated surfactants and peroxyacids (see column 1, lines 49–57). Thus, the art teaches away from the use of peroxyacids in non-aqueous liquids.

The detrimental interaction between peroxyacids and ethoxylated surfactants (e.g., in non-aqueous liquids) is further seen in U.S. Pat. No. 4,981,606 to Barnes where peroxyacid is stabilized only by using capped ethoxylated nonionic surfactant. The use of capped, alkoxylated nonionic is neither required nor preferred in the subject invention.

EP 484,095 mentions non-aqueous liquids (NALs) having stable solubilized imide peracids. By contrast, the peracids of the invention are substantially insoluble and such substantially insoluble peracids offer stability advantages over soluble peracids.

None of the above references teach or suggest non-aqueous liquid compositions containing peroxyacids of the invention. The aforementioned peroxyacids are substantially insoluble in non-aqueous liquids alone or in non-aqueous liquids containing other detergent solids. Further, none of the references teach or suggest that the peracids may only be stable if the builders and buffers are chosen according to specific criteria.

U.S. Ser. No. 07/970,344, now abandoned, which application is assigned to applicants' assignee, teaches non-aqueous liquids containing an inorganic persalt, particularly sodium percarbonate, and precursor compounds which are relatively insoluble in the non-aqueous, liquid phase. The application is concerned with the insolubility of the precursor and not with the insolubility of the specific peroxyacids of the invention. Moreover, carbonate salts are outside the scope of salts which should be used to ensure peracid stability according to the subject invention.

U.S. Pat. No. 5,268,003 to Coope et al. teaches the peroxyacids of the invention in aqueous liquids. At column 8, lines 20–21 there is mentioned, among a long list of product forms, that the peracids may be used in non-aqueous liquids. However, just because an acid may be insoluble in aqueous medium does not mean it will be insoluble in non-aqueous liquids or visa versa. Moreover, there is no teaching of how to stabilize the non-aqueous mediums since peroxyacids, including those of the invention, will not be stable in all non-aqueous mediums. They must be used under specified conditions. The lack of any teaching of conditions and the general teaching away in the art of using non-aqueous liquids for peracids strongly suggests that no-one of ordinary skill in the art would have known how to prepare the compositions of the invention based on the Coope et al. reference.

Accordingly, it is one object of the present invention to provide non-aqueous liquid compositions, particularly when the non-aqueous liquid phase is a liquid nonionic surfactant (preferably alkoxylated) or mixtures of such nonionic surfactants, wherein said compositions comprise amide or imide peroxyacids stable in the compositions. The non-aqueous liquid compositions preferably also comprise dispersed solids such as the insoluble peroxyacids of the invention and builder and buffer salts selected according to specific criteria defined by the invention.

It is a further object of the invention to provide peroxyacids which are substantially insoluble in the NALs such that their chemical stability is greatly enhanced.

Another object of the invention is to provide non-aqueous liquid compositions containing builder salts and buffer salts selected such that the salts, if used, are selected to minimize the detrimental effect on stability of the peroxyacid present in the liquid or actually enhance its stability.

Another object of the invention is to provide additional components to the compositions which may be used to further stabilize the peracids in the final compositions. Additional stabilizing components may include, for example, citric acid. Acid anionic surfactants (e.g., LAS), help stabilize citric acid containing compositions even further.

BRIEF SUMMARY OF THE INVENTION

The present invention provides non-aqueous liquids comprising peroxyacids which are stable in the NALs wherein the peroxyacids are substantially insoluble in the non-aqueous liquids. Preferably, the NAL comprises specifically selected builder salts and buffer salts. The solids are chosen such that a composition containing a nonionic surfactant, peracid and the selected salt/solid must have a half-life of the peracid in such compositions of greater than 5 days when measured at 37° C.

The peroxyacids used in the compositions of the invention are amide or imide peroxyacids having a solubility of 0 to about under 1500 ppm, preferably about under 1000 ppm, more preferably about under 750 ppm, more preferably about under 500 ppm, and most preferably under 200 ppm, wherein ppm refers to parts per million active oxygen. The surfactant used in NALs can comprise any nonionic surfactant that is liquid at room temperature but, for purposes of measuring solubility, we used Neodol 91-2.5 which is a nonionic surfactant having a chain length of 9 to 11 and an average 2 to 3 ethylene oxide units (2 to 3 EO). A mixture of nonionic surfactants may also be used for measuring solubility such as, for example, a mixture of 3 EO and 7 EO nonionics. It is also possible to use nonethoxylated nonionic surfactants for these measurements.

The present invention relates to NAL compositions comprising peroxyacids as defined above and further comprising about 1% to about 80% by wt., preferably 3% to 30% by wt. builder and 0.5% to 25% by wt., preferably 1% to 15% by wt. of a buffer salt. Both the builder and buffer are selected by measuring the half-life of peracid in a dispersion of nonionic and the selected solid. The peracid must have a half-life when measured at 37° C. of 5 days or greater.

In another embodiment of the invention, the invention provides compositions as defined above and further comprising enzymes. That is, the compositions comprise both stable peroxyacids and stable enzymes.

In a fourth embodiment of the invention, the invention provides an NAL composition as described above further comprising a stabilizing acid. An example of such an acid is citric acid.

In a fifth embodiment of the invention, the composition comprises nonionic surfactant, peracid, builder, buffer and stabilizing acid as defined above, and additionally comprises an anionic surfactant, e.g., LAS.

In a sixth embodiment of the invention, the invention provides a process for making the compositions of the invention wherein said process comprises mixing liquid surfactant with optional solids such as mentioned above other than peroxyacid, grinding the mixture to required particle size, and post-dosing any desired material of sufficiently small size and the peroxyacid and, optionally, enzymes.

DETAILED DESCRIPTION OF THE INVENTION

The present invention relates to non-aqueous liquid compositions comprising substantially insoluble peroxyacids which are stable in the non-aqueous liquids. The compositions of the invention may include, in addition to the peroxyacids, solid builder and solid buffer salts which are specifically selected to ensure peroxyacid stability. In a preferred embodiment of the invention, the non-aqueous liquids include stabilizing acids, (e.g., citric acids) and, in a more preferred embodiment, further comprise anionic surfactant acids, such as LAS.

While not wishing to be bound by theory, it is believed that the chemical stability of the peroxyacids in non-aqueous liquids is largely due to the fact that the peroxyacids are substantially insoluble in the non-aqueous liquids (NALs). More specifically, in this aspect of the invention, the invention is related to NALs comprising defined peroxyacids wherein the solubility of the peroxyacid in the NAL is from 0 to about under 1500 ppm, preferably under 1000 ppm, more preferably under 750 ppm, more preferably about under 500 ppm and most preferably about under 200 ppm wherein ppm signifies parts per million active oxygen. Typically solubility is measured in a non-capped, alkoxylated nonionic surfactant or mixture of such surfactants. In particular, the measurement is typically made in a $C_9$–$C_{11}$ ethoxylated surfactant having an average 2.5 EO units. The solubility measured in surfactant alone correlates well with the solubility in the continuous phase of a full NAL composition. Solubility may also be measured in a mixture of 7 EO and 3 EO ethoxylated surfactants, for example, or in nonalkoxylated nonionics.

Typically, the non-aqueous liquid compositions of the invention will comprise a surfactant composition wherein the surfactant is a nonionic surfactant or a mixture of surfactants wherein the first surfactant is a nonionic surfactant and other surfactant(s) may be additional nonionic surfactant or may be selected from the group consisting of anionic, cationic, amphoteric and ampholytic surfactants such as are known to those skilled in the art.

As noted above, the non-aqueous liquid composition of the composition of the invention comprises the peroxyacid of the invention as defined. The peroxyacid typically will comprise 0.1 to 10%, preferably 0.5 to 5% by wt. of the composition. The non-aqueous liquid composition of the invention also comprises 1 to 80% by weight, preferably 3 to 30% by wt. builder; and 0.5 to 25% by wt., preferably 1 to 15% by wt. buffer (e.g., sodium or potassium borate).

In addition to the peracid, builder and buffer, the compositions may further comprise enzymes, enzyme stabilizers, other components typical of NALs and small amounts of water. Typically, the non-aqueous liquids comprise under 5% by wt., preferably under 3% by wt. water. In a preferred embodiment of the invention, the compositions may comprise acid stabilizers (e.g., acid builders such as citric acid). In a more preferred embodiment, the compositions comprise, in addition to the acid stabilizers, an anionic surfactant acid, e.g., LAS.

In general, it will be understood that non-aqueous liquids contain dispersed solids whose content may vary, for example, from 10–90% by wt. usually from 30–80% and preferably 50–65% by wt. of the final composition. The solid phase should be in particulate form (when actually made) and have an average particle size of less than 300 μm, preferably less than 200 μm, more preferably less than 100 μm, especially less than 10 μm.

The particle size may even be of submicron size. The proper particle size can be obtained by using materials of the appropriate size or by milling the solid product in a suitable milling apparatus. In order to control aggregation of the solid phase leading to unredispersible settling or setting of the composition, it is preferred to use deflocculant therein.

In general all ingredients before incorporation will either be liquid in which case, in the composition they will constitute all or part of the liquid phase or they will be solids, in which case, in the composition they will either be dispersed in the liquid phase or they will be dissolved therein. Thus, "solids" are to be construed as materials in the solid phase which are added in the composition and are dispersed therein in solid form; those solids which dissolve in the liquid phase; and those in the liquid which solidify in the composition, wherein they are then dispersed.

The liquid phase (whether or not comprising liquid surfactant) is present in at least 10% by wt. of total composition and may be as high as 90% by wt., but in most cases the practical amount is between 20% and 70%; preferably 35 and 50% by wt. Solids content is as discussed above.

The compositions and the various ingredients of the compositions are described in further detail below:

Surfactant

As indicated above, the first component of the compositions of the invention is a surfactant or mixture of surfactants at least one of which surfactants in the mixture must be a nonionic surfactant which is typically liquid at room temperature.

Nonionic detergent surfactants are well-known in the art. They normally consist of a water-solubilizing polyalkoxylene or a mono-or di-alkanolamide group in chemical combination with an organic hydrophobic group derived, for example, from alkylphenols in which the alkyl group contains from about 6 to about 12 carbon atoms, dialkylphenols in which each alkyl group contains from 6 to 12 carbon atoms, primary, secondary or tertiary aliphatic alcohols (or alkyl-capped derivatives thereof), preferably having from 8 to 20 carbon atoms, monocarboxylic acids having from 10 to about 24 carbon atoms in the alkyl group and polyoxypropylenes. Also common are fatty acid mono- and dialkanolamides in which the alkyl group of the fatty acid radical contains from 10 to about 20 carbon atoms and the alkyloyl group having from 1 to 3 carbon atoms. In any of the mono- and di-alkanolamide derivatives, optionally, there may be a polyoxyalkylene moiety joining the latter groups and the hydrophobic part of the molecule. In all polyalkoxylene containing surfactants, the polyalkoxylene moiety preferably consists of from 2 to 20 groups of ethylene oxide or of ethylene oxide and propylene oxide groups. Amongst the latter class, particularly preferred are those described in European specification EP-A-225,654 (Unilever). Also preferred are those ethoxylated nonionics which are the condensation products of fatty alcohols with from 9 to 15 carbon atoms condensed with from 3 to 11 mols of ethylene oxide. Examples of these are the condensation products of $C_{11-13}$ alcohols with, for example, 3 or 7 moles of ethylene oxide. These may be used as the sole nonionic surfactants or in combination with those of the described in the last mentioned European specification, especially as all or part of the liquid phase.

Another class of suitable nonionics comprise the alkyl polysaccharides (polyglycosides/oligosaccharides) such as described in any of specifications U.S. Pat. Nos. 3,640,998; 3,346,558; 4,223,129; EP-A-92,355; EP-A-99,183; EP-A-70,074, '75, '76, '77; EP-A-75,994, '95, '96.

Nonionic detergent surfactants normally have molecular weights of from about 300 to about 11,000. Mixtures of different nonionic detergent surfactants may also be used, provided the mixture is liquid at room temperature. Mixtures of nonionic detergent surfactants with other detergent surfactants such as anionic, cationic or ampholytic detergent surfactants and soaps may also be used. If such mixtures are used, the mixture must be liquid at room temperature.

Examples of suitable anionic detergent surfactants which can be used in combination with nonionic surfactant(s) are alkali metal, ammonium or alkylolamine salts of alkylbenzene sulphonates or of alkylbenzene sulfonic acids having from 10 to 18 carbon atoms in the alkyl group; alkyl and alkylether sulphates having from 10 to 24 carbon atoms in the alkyl group, the alkylether sulphates having from 1 to 5 ethylene oxide groups; olefin sulphonates prepared by sulphonation of $C_{10}$–$C_{24}$ alpha-olefins and subsequent neutralization and hydrolysis of the sulphonation reaction product. The alkylbenzene sulphonic acids are particularly preferred especially in combination with acid builder such as citric acid since the acid surfactants and/or acid builders as acid stabilizers to further enhance peroxyacid stability.

Other surfactants which may be used include fatty acids or alkali metal soaps of a fatty acid, preferably one containing 12 to 18 carbon atoms. Typical such acids are oleic acid, ricinoleic acid and fatty acids derived from castor oil, rapeseed oil, groundnut oil, coconut oil, palm kernel oil or mixtures thereof. The sodium or potassium soaps of these acids can be used. As well as fulfilling the role of surfactants, soaps can act as detergency builders or fabric conditioners, other examples of which will be described in more detail hereinbelow. It can also be remarked that the oils mentioned in this paragraph may themselves constitute all or part of the liquid phase, whilst the corresponding low molecular weight fatty acids (triglycerides) can be dispersed as solids or function as structurants.

Yet again, it is also possible to utilize cationic, zwitterionic and amphoteric surfactants in combination with the nonionic surfactant. Examples of cationic detergent surfactants are aliphatic or aromatic alkyl-di(alkyl) ammonium halides and examples of soaps are the alkali metal salts of $C_{12}$–$C_{24}$ fatty acids. Ampholytic detergent surfactants are e.g., the sulphobetaines.

When a non-aqueous liquid product is actually formulated, in addition to the surfactant, the liquid phase of the NAL may also comprise a non-aqueous organic solvent. Generally, the most suitable solvents are organic materials with polar moieties. In particular, these include molecules comprising a relatively lipophilic part and relatively hydrophilic part, especially a hydrophilic part rich in electron base pairs. This is in accordance with the observation that liquid surfactants, especially polyalkoxylated nonionics, are preferred surfactants.

Non surfactant solvents include those of the type discussed above although other kinds may be used, especially if combined with the preferred types.

In general the non-surfactant can be used alone or in combination with liquid surfactants.

Non-surfactant solvents having structures falling in the preferred categories include ethers, polyethers, alkylamines and fatty amines (especially di-, and tri-alkyl and/or fatty N substituted amines), alkyl (or fatty) amides and mono- and di- N-alkyl substituted derivatives thereof, alkyl (or fatty) carboxylic acid lower alkyl esters, ketones, aldehydes and polyamides. Examples include di-alkyl ether, polyethylene glycols, alkyl ketones (such as acetone) and glyceryl trialkylcarboxylates (such as glyceryl triacetate), glycerol, propylene glycol, and sorbitol.

Many light solvents with little or no hydrophilic character are in most systems unsuitable on their own such as, for example, lower alcohols (e.g. ethanol) or higher alcohols (e.g., dodecanol) as well as alkanes and olefins. However they can be combined with other liquid material.

As mentioned above, the liquid phase of a product can comprise 10% to 90% by wt. of the final product.

In general, the surfactant or mixture of surfactants will comprise 5% to 75% by wt. of the non-aqueous liquid, preferably 15% to 60% by weight, most preferably 25–50% by wt.

Solid Phase

In addition to liquid surfactant phase, the compositions of the invention comprise a "solids" phase which includes the peroxyacid (discussed in more detail below) and which also preferably includes several other components, discussed immediately below.

Builder

The compositions of the invention may contain a builder in the solid phase. The builder in turn is selected specifically by meeting a stability test of a peracid in a model continuous phase containing the builder and as described in Example 3 below. Specifically, the builder is placed in a system with nonionic surfactant and peracid and the half-life of the peracid is measured. The peracid must have a half-life of greater than 5 days when measured at 37° C. in order for the builder to be selected.

While not all builders have been tested, any builder which meets the criteria noted above can be used. Thus, referring to Example 3, for example, builders could include bicarbonate, zeolite, borate, oxydisuccinic acid (ODS) or citrate, but not carbonate.

In general, builders may be inorganic or organic and, assuming they meet the stability test, may be phosphorous-containing or non-phosphorous.

Generally, inorganic builders include phosphate, silicate, borate, and aluminosilicate type materials, particularly the alkali metal forms. Mixtures of these may also be used.

Examples of phosphorus-containing inorganic builders, when present, include the water-soluble salts, especially alkali metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic builders, when present, include water-soluble alkali metal borates, silicates, metasilicates, and crystalline and amorphous alumino silicates. Specific examples include silicates and zeolites, particularly zeolite 4A & zeolite P (zeolite A24). Zeolite P is defined in, for example, EP 0,384,070 and PCT 93/01521, both of which are incorporated by reference into the subject application. There is, however, no disclosure or suggestion to include, the particular zeolite materials in a non-aqueous liquid comprising a non-aqueous phase which may also contain dispersed particles.

In general, zeolite P has silicon to aluminum ratio not exceeding 1.33; a water content of the zeolite material less than 25% based on hydrated zeolite and has a calcium binding capacity of at least 150 mg CaO per gram of anhydrous material.

Examples of organic builders include the alkali metal, ammonium and substituted, citrates, succinates, malonates, fatty acid sulphonates, carboxymethoxy succinates, ammonium polyacetates, carboxylates, polycarboxylates, aminopolycarboxylates, polyacetyl carboxylates and polyhydroxysulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

Other suitable organic builders include the higher molecular weight polymers and co-polymers known to have builder properties, for example appropriate polyacrylic/polymaleic acid co-polymers as their alkalimetal salts, such as those sold by BASF under the Sokalan Trademark.

The aluminosilicates are an especially preferred class of non-phosphorus inorganic builders. These for example are crystalline or amorphous materials having the general formula:

$$Na_z(AlO_2)_z(SiO_2)_y x\ H_2O$$

wherein Z and Y are integers of at least 6, the molar ratio of Z to Y is in the range from 1.0- to 0.5, and x is an integer from 6 to 189 such that the moisture content is from about 4% to about 25% by weight (termed herein, 'partially hydrated'). This water content provides the best rheological properties in the liquid. Above this level (e.g., from about 19% to about 28% by weight water content), the water level can lead to network formation. Below this level (e.g., from 0 to about 6% by weight water content), trapped gas in pores of the material can be displaced which causes gassing and tends to lead to a viscosity increase also. However, it will be recalled that anhydrous materials (i.e., with 0 to about 6% by weight of water) can be used as structurants. The preferred range of aluminosilicate is from about 12% to about 30% on an anhydrous basis. The aluminosilicate preferably has a particle size of from 0.1 to 100 microns, ideally between 0.1 to 10 microns and a calcium ion exchange capacity of at least 200 mg calcium carbonate/g.

As noted above, acid builders such as citric acid are particularly preferred builders in that the acid builders may be used alone or in combination with acid surfactants (e.g., LAS) to further stabilize peroxyacids.

These builder materials may be present at a level of, for example, from 1 to 80% by weight, preferably from 3 to 30% by weight.

Buffer

The compositions of the invention also may contain a buffer in the solid phase. The buffer salt/solid is selected in the same manner as is selected the builder. That is, the buffer is placed in a model continuous phase containing peracid. Specifically, the buffer is placed in a system containing nonionic surfactant and peracid and the half life of the peracid is measured. The peracid must have a half-life of 5 days or greater when measured at 37° C. in order to be selected. In a preferred embodiment, the buffer is sodium or potassium borate or bicarbonate.

Peroxyacid

The compositions of the invention also comprise an effective bleaching amount of an amido or imido organic peroxyacid having a solubility in the surfactant system of the invention, and in particular in a nonionic surfactant, of 0 to about under 1500 parts per million active oxygen when solubilized in the surfactant. It should be noted that solubility in nonionic alone correlates with solubility in continuous phase of composition after centrifugation of solids.

Peroxyacids of the present invention may be selected from mono- or di-percarboxylic amido or imido acids. The mono-percarboxylic acids are of the general formula:

$$R(R^1N)_nC(NR^2)_m\cdots R^3\cdots \overset{\overset{\displaystyle O}{\|}}{C}OOM$$

wherein:

R is selected from the group consisting of $C_1$–$C_{16}$ alkyl, $C_1$–$C_{16}$ cycloalkyl and $C_6$–$C_{12}$ aryl radicals;

$R^1$ is selected from the group consisting of hydrogen, $C_1$–$C_{16}$ alkyl, $C_1$–$C_{16}$ cycloalkyl and $C_6$–$C_{12}$ aryl radicals;

$R^2$ is selected from the group consisting of hydrogen, $C_1$–$C_{16}$ alkyl, $C_1$–$C_{16}$ cycloalkyl and $C_6$–$C_{12}$ aryl radicals and a carbonyl radical that can form a ring together with R when $R^3$ is arylene;

$R^3$ is selected from the group consisting of $C_1$–$C_{16}$ alkylene, $C_5$–$C_{12}$ cycloalkylene and $C_6$–$C_{12}$ arylene radicals;

n and m are integers whose sum is 1; and

M is selected from the group consisting of hydrogen, alkali metal, alkaline earth metal, ammonium and alkanolammonium cations and radicals.

The di-percarboxylic acids of the present invention may be of the general formula:

$$MOOCR^4(R^5N)_{n'}C(MR^6)_{n''}\cdots R^3\cdots(R^6N)_{m'}C(NR^5)_{m''}R^4COOM$$

wherein:

each $R^4$ is independently selected from the group consisting of $C_1$–$C_{12}$ alkylene, $C_5$–$C_{12}$ cycloalkylene, $C_6$–$C_{12}$ arylene and radical combinations thereof;

each $R^5$ is independently selected from the group consisting of hydrogen, $C_1$– $C_{16}$ alkyl and $C_6$–$C_{12}$ aryl radicals and a carbonyl radical that can form a ring together with $R^3$;

each $R^6$ is independently selected from the group consisting of hydrogen, $C_1$– $C_{16}$ alkyl and $C_6$–$C_{12}$ aryl radicals and a radical that can form a $C_3$–$C_{12}$ ring together with $R^3$;

$R^3$ is selected from the group consisting of $C_1$–$C_{12}$ alkylene, $C_5$–$C_{12}$ cycloalkylene and $C_6$–$C_{12}$ arylene radicals;

n' and n" each are an integer chosen such that the sum thereof is 1;

m' and m" each are an integer chosen such that the sum thereof is 1; and

M is selected from the group consisting of hydrogen, alkali metal, alkaline earth metal, ammonium and alkanolammonium cations and radicals.

Amounts of the amido or imido peroxyacids of the present invention may range from about 0.1 to about 40%, preferably from about 1 to about 10% by weight.

Preferably, the peroxyacid is an amide peracid. More preferably, the amide is selected from the group of amido peracids consisting of N,N'-Terephthaloyl-di(6-aminopercarboxycaproic acid) (TPCAP), N,N'-Di(4-Percarboxybenzoyl)piperazine (PCBPIP), N,N'-Di(4-Percarboxybenzoyl-)ethylenediamine (PCBED), N,N'-di(4-Percaboxybenzoyl)-1,4-butanediamine (PCBBD) N,N'-Di(4-Percarboxyaniline)terephthalate (DPCAT), N,N'-Di(4-Percarboxybenzoyl)-1,4-diaminocyclohexane (PCBHEX), N,N'-Terephthaloyl-di(4-amino peroxybutanoic acid) ($C_3$ TPCAP analogue called TPBUTY) N,N'-Terphthaloyl-di(8-amino peroxyoctanoic acid) ($C_7$ TPCAP analogue called TPOCT), N,N'-Di(percarboxyadipoyl)phenylenediamine (DPAPD) and N,N'-Succinoyl-di(4-percarboxy)aniline (SDPCA).

The present invention is further defined in that a non-aqueous liquid comprising the ingredients noted above (i.e, nonionic surfactant-containing liquid phase and solid phase comprising peracid, and preferably containing builder and buffer selected as noted above) will be peracid containing compositions wherein the half-life stability of the peracid within the composition will be greater than 5 days. In other words, if all ingredients are properly selected, the stability of the full composition will be as noted. The peracid may also be any of the NAPAA or NAPSA acids described in U.S. Pat. Nos. 4,686,063 (Burns) or 4,909,953 (Sadlowski), both of which are incorporated by reference into the subject application.

Optional Ingredients

The compositions of the invention optionally may also contain one or more minor ingredients such as fabric conditioning agents, enzymes, perfumes (including deoperfumes), micro-biocides, coloring agents, fluorescers, soil-suspending agents (anti-redeposition agents), corrosion inhibitors, enzyme stabilizing agents, and lather depressants.

When enzymes are used in the present composition, it is preferred to add the enzyme in the form of nonionic slurries such as, for example, those taught in U.S. Pat. No. 4,906,396 to Falholt et al., hereby incorporated by reference into the subject application.

The enzyme slurry may also be enzyme particles in a silicone oil or silicone antifoam.

The compositions are substantially non-aqueous, i.e., they contain little or no free water, preferably no more than 5%, preferably less than 3%, especially less than 1% by weight of the total composition.

The products which can be made according to this invention are liquid cleaning products. References to liquids refer to materials which are liquid at 25° C. at atmospheric pressure. They may be formulated in a wide range of forms depending on use. They may be formulated as cleaners for hard surfaces (with or without abrasive) or as agents for ware washing (cleaning of dishes, cutlery etc.) either by hand or mechanical means, as well as in the form of specialized cleaning products, such as for surgical apparatus for artificial dentures. They may also be formulated as agents for washing and/or conditioning of fabrics.

Thus, the compositions will usually contain at least one agent which promotes the cleaning and/or conditioning of the article(s) in question, selected according to intended application. Usually the agent is selected from surfactants, enzymes, bleaches, microbiocides, fabric softening agents (for fabrics) and (in the case of hard surface cleaners) abrasives. Of course in many cases, more than one agent will be present as well as other ingredients commonly used in the relevant product form.

Preferably, the viscosity of compositions is less than 2,500 mPas at 21 $sec^{-1}$, more preferably between 50 and 2000, most preferably from 300 to 1500.

Since the objective of a non-aqueous liquid will generally be to enable the formulator to avoid the negative influence of water on the components, e.g., causing incompatibility of functional ingredients, it is clearly necessary to avoid the accidental or deliberate addition of water to the product at any stage in its life. For this reason, special precautions are necessary in manufacturing procedures and pack designs for use by the consumer.

Thus during manufacture, it is preferred that all raw materials should be dry and (in the case of hydratable salts) in a low hydration state, e.g., anhydrous phosphate builder, sodium perborate monohydrate and dry calcite abrasive, where these are employed in the composition. In a preferred process, the dry, substantially anhydrous solids are blended with the liquid phase in a dry vessel. In order to minimize the rate of sedimentation of the solids, this blend is passed through a grinding mill or a combination of mills, e.g., a colloid mill, a corundum disc mill, a horizontal or vertical agitated ball mill, to achieve a particle size of 0.1 to 100 microns, preferably 0.5 to 50 microns, ideally 1 to 10 microns. A preferred combination of such mills is a colloid mill followed by a horizontal ball mill since these can be operated under the conditions required to provide a narrow size distribution in the final product. Of course, particulate material already having the desired particle size need not be subjected to this procedure and if desired, can be incorporated during a later stage of processing.

During this milling procedure, the energy input results in a temperature rise in the product and the liberation of air entrapped in or between the particles of the solid ingredients. It is therefore highly desirable to mix any heat sensitive ingredients (i.e., peracid or enzyme) into the product after the milling stage and a subsequent cooling step. It may also be desirable to de-aerate the product before addition of these (usually minor) ingredients and optionally, at any other stage of the process. Typical ingredients which might be added at this stage are perfumes and enzymes, but might also include highly temperature sensitive bleach components or volatile solvent components which may be desirable in the final composition. However, it is especially preferred that volatile material be introduced after any step of aeration. Suitable equipment for cooking (e.g., heat exchanges) and de-aeration will be known to those skilled in the art.

It follows that all equipment used in this process should be completely dry, special care being taken after any cleaning operations. The same is true for subsequent storage and packing equipment.

In one preferred embodiment of the invention, the non-aqueous liquid composition invention comprises, in addition to nonionic surfactant and peroxyacid, a solid builder selected from the group consisting of polycarboxylate builders (e.g., Na- or K-citrate, Na- or K-oxydisuccinic acid) and zeolites (e.g., zeolite 4A or zeolite P) and a buffer such as sodium or potassium borate.

In yet another preferred embodiment of the invention, the composition comprises a surfactant system comprising a 30 to 70% by wt. nonionic surfactant, and 70% to 30% of a solid wherein the solid comprises a builder selected from the group consisting of zeolites, citrates and mixtures thereof and wherein the solid further comprises a buffer which is sodium or potassium borate.

In an especially preferred embodiment of the invention, the composition comprises nonionic surfactant, peroxyacid, a builder and a buffer (such as sodium borate) and additionally comprises a second builder which is an acid builder, such as citric acid.

In a yet more specifically preferred embodiment, the composition having a builder and a second acid builder additionally comprises an acid surfactant such as LAS (Linear alkyl benzene sulfonic acid). While not wishing to be bound by theory, these ingredients are believed to reduce the alkalinites of the system and thereby improve peracid stabilization.

From the above, it should be noted that the subject invention is intended to encompass the stability of peracids (and also preferably enzymes) in model novel non-aqueous compositions which include builders, buffers and continuous surfactant phase (non-aqueous). It will be understood that the stability of the peracid also varies to some degree depending on which particular builder or which particular buffer is used and therefore the correct selection is very important in determining stability of the peracid. Nonetheless, the peracid will have much greater stability if it is substantially insoluble (as defined above) in the continuous phase (regardless of which builder or buffers are used) relative to the stability of peracids which are soluble in the continuous phase. In shod, neither choice of peracid nor choice of solid can be ignored.

Finally, it should be noted that all systems made thus far are not physically stable because the particles were not actually milled as described and products not actually made (although ingredients which can be used in products are described). However, it is well within the skill of the art to formulate the components to obtain physical stability by means taught and described in the art.

More specifically, solid stabilizers may include deflocculants such as described in U.S. Pat. No. 5,147,576 to Montague et al.; stabilizers such as voluminous metal and metal oxides (described in GB 1,205,711) or hydrophobically modified silicas; or stabilizing polymers, for example.

Unless stated otherwise, all percentages cited are intended to be percentages by weight.

The invention is described in greater detail in the following examples. The examples are intended to be illustrative only and are not intended to limit the invention in any way.

EXAMPLE 1

The solubility of a number of peracids was tested in a model continuous phase, i.e., Neodol 91-2.5 which is an ethoxylated nonionic surfactant having $C_9$–$C_{11}$ chain length and alkoxylated with an average 2.5 ethylene oxide units per molecule. Solubility is defined as parts per million active oxygen (AO)in the continuous phase after adding the peracid to the phase and mixing at room temperature for at least one hour. The lower the active oxygen in the continuous phase, the lower is the peracid solubility in the medium. The peracid and measured solubilities are set forth below:

| Peracid | Solubility in Neodol 91-2.5 (ppm AO) Measured at Room Temperature (i.e., 25° C.) |
|---|---|
| PAP | 2000 |
| PCBED | 149 |
| TPCAP | 15 |
| PCBPIP | 22 |
| PCBHEX | 34 |
| PCBBD | 77 |
| DPCAT | 20 |
| DIPAP | 25 |

PAP is Phthalimidoperhexanoic acid

PCBED is N,N'-Di(4-Percarboxybenzoyl)ethylenediamine

TPCAP is N,N'-Terephthaloyl-di(6-aminopercarboxycaproic acid)

PCBPIP is N,N'-Di(4-percarboxybenzoyl)piperazine

PCBHEX is N,N'-Di(4-Percarboxybenzoyl)-1,4-diaminocyclohexane

PCBBD is N,N'-Di(4-Percarboxybenzoyl)-1,4-butanediamine

DPCAT is N,N'-Di(4-Percarboxyaniline)terephthalate

DIPAP is N,N,N'N'-1,2,4,5-tetracarboxybenzoyl-di(6-aminopercarboxycaproic acid)

As noted above, only PAP has a solubility outside the range defined by the invention and would therefore not be expected to be stable in non-aqueous liquids.

To show that the low solubility levels in model continuous phase (i.e., nonionic alone) would be expected to correlate with equally low solubility in the continuous phase of a full nonaqueous liquid (NAL) formulation, three peracids (PCBPIP, PCBHEX and DIPAP) were further tested in an NAL as set forth below:

Formulation I

| Ingredient | % by Weight |
|---|---|
| Nonionic Alkoxylated with 7 ethylene oxide units ($C_{10}$–$C_{12}$) | 28 |
| $C_{13}$–$C_{15}$ Nonionic alkoxylated with 3 ethylene oxide units | 23 |
| Glycerol triacetate | 6 |
| Silicone antifoam | 1.5 |
| Alkyl benzene sulphonic acid | 7 |
| Sodium Carbonate | 20 |
| Calcite | 7 |
| Antiseeding polymer (e.g., Versa TL-3) | 2 |

-continued

| Formulation I | |
|---|---|
| Ingredient | % by Weight |
| Silica | 4 |
| Carboxy methyl cellulose (anti-redeposition) | 2 |
| Brightener | 0.2 |
| Perfume | 0.6 |

Results of solubility in continuous phase of full solution (compared to Neodol 91-2.5 only) are set forth below:

| Peracid | Solubility in Neodol 91-2.5 | Solubility in Continuous Phase of Full Solution Above |
|---|---|---|
| PCBPIP | 22 | 30 |
| PCBHEX | 34 | 44 |
| DIPAP | 25 | 20 |

As can be seen, low solubility in the model system (Neodol 91-2.5 only) correlates well with solubility (i.e., measure of stability) in the continuous phase of the full composition.

EXAMPLE 2

Having established solubility measurements, three peracids (i.e., PAP, outside the scope of the invention; and TPCAP and PCBPIP, within the scope of the invention) were analyzed at room temperature to determine stability in Formulation I described in Example 1. Stability was defined by the amount of time it takes for the initial level of active oxygen (measured in ppm) to reach half the level of initial active oxygen. Results are set forth below:

| Stability of Peracid in NAL at Room Temperature | | |
|---|---|---|
| Peracid | Stability in NAL (time for ½ initial AO) | Solubility |
| PAP (initial 2000 ppm) | <10 hours | 2000 ppm |
| TPCAP (initial 2500 ppm) | 8 days | 15 ppm |
| PCBPIP (initial 1300 ppm) | 10 days | 22 ppm |

As can be seen from the results above, where the solubility of the peracid was greater than 1500 ppm AO (i.e., PAP at 2000 ppm), stability was less than 10 hours while, by contrast, when solubility was lower (i.e., for TPCAP and PCBPIP), stability was as great as 8 to 10 days.

EXAMPLE 3

Stability of Peracid in Model Continuous Phase Plus Builder

Applicants further wanted to see the stability effect on the peracid in a system using a continuous phase plus builder. Specifically, applicants tested various builders (using about 27 wt. % solid) in a continuous phase wherein the continuous phase comprises 50% by weight nonionic surfactant alkoxylated with 3 ethylene oxide units (Vista 1012-45) and 50% by wt. nonionic surfactant alkoxylated with 7 ethylene oxide units (Vista 1012-62).

Specifically, the model system is set forth as follows:

Solid: 15 grams

Vista 1012-45: 20 grams

Vista: 1012-62: 20 grams

TPCAP 2500 ppm initial activity.

Various solids were tested in this system and the stability (half life to obtain half initial active oxygen levels) of TPCAP at 37° C. was measured and results set forth below:

| Solid/Builder | TPCAP Stability in Model NAL t ½, 37° C. |
|---|---|
| Sodium Carbonate | 2 days |
| Sodium Bicarbonate | 5 days |
| Zeolite 4A | 7 days |
| Sodium Tetraborate .10 aq | 11 days |
| Sodium Oxydisuccinate | 15 days |
| Sodium Sulphate | 25 days |
| Sodium Citrate .2 aq | 26 days |

Stability varied depending on which builder was used. It can be seen that carbonate does not meet stability requirements of the invention (i.e., 5 days or greater). When using builders other than carbonate, stability reached as high as 26 days. Indeed, citrate builder was the most preferred builder resulting in half life stability of 26 days.

EXAMPLE 4

In another example to show the effect of the builder on peracid stability 2 to 3 mg TPCAP was contacted with 2 g model NAL composition comprising:

| | |
|---|---|
| Vista 1012-62: | 27.3 parts |
| Dobanol 25-3 ($C_{12}$–$C_{15}$ nonionic alkoxylated with 3 ethylene oxide units) | 22.4 parts |
| LAS (Linear alkyl benzene sulfonic acid) | 6.0 parts |
| Builder* | 22.4 parts |

*either (1) 16.4 parts Na carbonate + 6.0 parts calcite; (2) 22.4 parts Na metaborate; or (3) 22.4 zeolite P.

Stability evaluated according to percent residual peracid exhibited the following:

(1) had 10% remaining peracid after 7 days measured at room temperature;

(2) had 80% remaining peracid when measured at same conditions;

(3) had 90% remaining peracid when measured under same conditions.

As can be seen, the metaborate and zeolite clearly have superior stability relative to the carbonate/calcite builder system.

EXAMPLE 5

In order to show that buffer salts (e.g., borate) can also be included in the composition, applicants also tested Na borate and TPCAP in a similar model system described in Example 3, i.e., 15 grams solid to 40 grams surfactant. For this system results were:

| Solid/Buffer | TPCAP Stability in Model NAL to ½, 37° C. |
|---|---|
| Na Borate | 11 days |

The sodium borate solid buffer thus clearly meets the 5 day or greater stability test as for the builders of the invention described in Example 3.

EXAMPLE 6

Stability of Peracid in Systems Containing both Builder and Buffer

Applicants next wished to test peracid stability (i.e., stability of TPCAP having initial AO of 2500 ppm) in systems comprising surfactant (i.e., mixture of nonionics), builder and buffer. The effect of the mixture of solids on peracid stability measured at 37° C. is set forth below.

Effect of a Mixture of Solids on the Stability of TPCAP at 37° C.

| Composition | (Initial level of TPCAP was 2500 ppm) | Peracid Stability in Model NAL, to ½, 37° C. |
|---|---|---|
| A | 20 g 7EO*/20 g 3EO+/30 g Zeolite/15 g borate | 9 days |
| B | 20 g 7EO/20 g 3EO/30 g citrate/15 g borate | 9 days |
| C | 20 g 7EO/20 g 3EO/30 g Zeolite/5 g citrate/15 g Borate | 14 days |
| D | 20 g 7EO/20 g 3EO/4 g citrate/1 g citric acid/30 g zeolite/15 g borate | 15 days |

Again, it can be seen that peracids of the invention retain good stability with the proper selection of builder and buffer.
*7EO is Vista 1012-62
+3EO is Vista 1012-45

As seen above, compositions A and B (where 1 builder selected according to the invention and one buffer selected according to the invention are used) had half-life stability of 9 days. When a mixed zeolite/citrate builder system is used (Composition C), half-life is 14 days, and when additional builder acid is used (Composition D), half-life is 15 days.

EXAMPLE 7

Stability of Peracid in Systems Containing Builder, Buffer, and Acid Surfactant

Stability of Peracid in Systems Containing Builder, Buffer, and Acid Surfactant

| Composition | Composition (Initial level of TPCAP was 2500 ppm | Peracid Stability in Model NAL, $t_{½}$ at 37° C. |
|---|---|---|
| E | 40 g Genapol 26-6-60N (7EO nonionic), 2 g LAS acid, 2 g citric acid, 15 g borate, 30 g zeolite | 27 days |
| F | 40 g Vista 1012-62 (7EO nonionic), 2 g LAS acid, 2 g citric acid, 15 g borate, 30 g zeolite | 30 days |

As can be noted, in a composition of the invention which additionally comprises both acid builder (citric acid) and surfactant acid (LAS), half-life stability of TPCAP in this system reached up to 30 days (Composition F).

EXAMPLE 8

Enzyme Stability 14,000 GU/g Durazyme was dosed as a slurry into the composition of Example 1 also comprising either PCBPIP or TPCAP. In both cases there was more than 90% residual enzyme activity after one month storage at 37° C. in the presence of about 1000 ppm initial active oxygen PCBPIP or TPCAP

We claim:

1. A non-aqueous liquid composition comprising a liquid phase which comprises (1) from 5 to 75% by wt. of a nonionic surfactant or mixture of surfactants at least one of which surfactants in the mixture is a nonionic surfactant; and (2) a solid phase comprising;

(a) from 0.1 to 10% by wt. peroxyacid having a solubility of less than about 1500 ppm active oxygen when said peracid is dispersed in said nonionic surfactant wherein said peroxyacid is a dipercarboxylic amido or imido acid selected from the group consisting of:

(1) dipercarboxylic acids having the formula:

$$MOOCR^4(R^5N)_{n'}C(\overset{O}{\overset{\|}{}})(MR^6)_{n''}\cdots R^3\cdots(R^6N)_{m'}C(\overset{O}{\overset{\|}{}})(NR^5)_{m''}R^4COOM$$

wherein:

$R^4$ is selected from the group consisting of $C_1$–$C_{12}$ alkylene, $C_5$–$C_{12}$ cyoloalkylene, $C_6$–$C_{12}$ arylene and radical combinations thereof;

$R^5$ is selected from the group consisting of hydrogen, $C_1$–$C_{16}$ alkyl and $C_6$–$C_{12}$ aryl radicals and a carbonyl radical that can form a ring together with $R^3$;

$R^6$ is selected from the group consisting of hydrogen, $C_1$–$C_{16}$ alkyl and $C_6$–$C_{12}$ aryl radicals and a radical that can form a $C_3$–$C_{12}$ ring together with $R^3$;

$R^3$ is selected from the group consisting of $C_1$–$C_{12}$ alkylene, $C_5$–$C_{12}$ cycloalkylene and $C_6$–$C_{12}$ arylene radicals;

n' and n" each are an integer chosen such that the sum thereof is 1;

m' and m" each are an integer chosen such that the sum thereof is 1; and

M is selected from the group consisting of hydrogen, alkali metal, alkaline earth metal, ammonium and alkanolammonium cations and radicals;

(b) about 1% to about 80% by wt. of a builder or mixture of builders selected from the group consisting of polycarboxylate builders, sodium sulfate and zeolites; and (c) 0.5 to 25% by wt. buffer compound or mixture of buffer compounds selected from the group consisting of borate, boric acid and bicarbonate;

wherein the half-life stability of the peracid in the final composition, when measured at 37° C. is 5 days or greater.

2. A composition according to claim 1, wherein said peroxyacid has a solubility less than 1000 ppm active oxygen when said peracid is dispersed in said nonionic surfactant.

3. A composition according to claim 2, wherein said peroxyacid has a solubility less than 750 ppm active oxygen when said peracid is dispersed in said nonionic surfactant.

4. A composition according to claim 3, wherein said peroxyacid has a solubility less than 500 ppm active oxygen when said peracid is dispersed in said nonionic surfactant.

5. A composition according to claim 4, wherein said peroxyacid has a solubility less than 200 ppm active oxygen when said peracid is dispersed in said nonionic surfactant.

6. A composition according to claim 1, wherein said composition is selected from the group of peroxyacids consisting of N,N'-Di(4-Percarboxybenzoyl)ethylenediamine (PCBED), N,N'-Terephthaloyl-di(6-aminopercarboxycaproic acid) (TPCAP), N,N'-Di(4-percarboxybenzoyl)piperazine (PCBPIP), N,N'-Di(4-Percarboxybenzoyl)-1,4-diaminocyclohexane (PCBHEX), N,N'-Di(4-Percarboxybenzoyl)-1,4-butanediamine (PCBBD), N,N'-

Di(4-Percarboxyaniline)terephthalate (DPCAT), N,N,N'N'-1,2,4,5-tetracarboxybenzoyl-di(6-aminopercarboxycaproic acid) (DiPAP), N,N'-Di(percarboxyadipoyl)phenylenediamine (DPAPD), N,N'-Succinoyl-di(4-percarboxy)aniline (SDPCA), $C_3$ analog of N,N'-Terephthaloyl-di(4-amino peroxybutanoic acid) (TPBUTY) and $C_9$ analog of N,N'-Terephthaloyl-di(8-amino peroxyoctanoic acid) (TPOCT).

7. A composition according to claim 1, where the nonionic surfactant is liquid at room temperature.

8. A composition according to claim 1, where the zeolite builder is zeolite P.

9. A composition according to claim 1, wherein said polycarboxylate builder is a citrate.

10. A composition according to claim 1, wherein the solid phase further comprises an amount of enzyme sufficient to provide enzyme detergency.

11. A composition according to claim 10, wherein said enzyme is selected from the group consisting of proteases, lipases, amylases, cellulase, oxidases and mixtures thereof.

12. A composition according to claim 10, wherein said enzyme is incorporated into the composition in the form of an enzyme slurry.

13. A composition according to claim 12, wherein said enzyme slurry is a slurry of an enzyme in a nonionic surfactant or a slurry of enzyme particles in a silicone oil or a silicone antifoam.

14. A non-aqueous liquid composition according to claim 1, wherein the liquid phase (1) comprises a nonionic surfactant, the solid phase (2)(b) comprises zeolite and the solid phase (2)(c) comprises borate.

15. A composition according to claim 14, wherein the solid phase (2) further comprises an amount of enzyme or enzymes sufficient to provide enzyme detergency.

16. A composition according to claim 15, wherein the enzyme is incorporated into the composition in the form of an enzyme slurry.

17. A non-aqueous liquid composition according to claim 1, wherein the liquid phase (1) comprises a nonionic surfactant and the solid phase (2)(b) comprises citrate and the solid phase (2)(c) comprises borate.

18. A composition according to claim 17, wherein the liquid phase further comprises an amount of enzyme or enzymes sufficient to provide enzyme detergency.

19. A composition according to claim 17, wherein the enzyme is incorporated into the composition in the form of an enzyme slurry.

20. A composition according to claim 14, which additionally comprises an acid builder.

21. A composition according to claim 20, wherein the builder is a polycarboxylic acid or salt.

22. A composition according to claim 21, wherein the builder is a polycarboxylic acid which is citric acid.

23. A composition according to claim 20, wherein the liquid phase is a mixture which comprises, in addition to nonionic surfactant, a surfactant acid.

24. A composition according to claim 23, wherein the surfactant acid is alkyl benzene sulfonic acid.

25. A composition according to claim 20, further comprising an amount of enzyme or enzymes sufficient to provide enzyme detergency.

26. A process for making a non-aqueous liquid composition according to claim 1 which process comprises mixing said liquid phase and solids from said solid phase, grinding said solids to required particle size and subsequently adding said peracid or enzyme or mixtures thereof.

* * * * *